US008102385B2

(12) United States Patent
Lee et al.

(10) Patent No.: US 8,102,385 B2
(45) Date of Patent: Jan. 24, 2012

(54) DRIVING CIRCUIT OF LIQUID CRYSTAL DISPLAY DEVICE AND METHOD FOR DRIVING THE SAME

(75) Inventors: Seok Woo Lee, Seoul (KR); Nam Hee Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 908 days.

(21) Appl. No.: 11/027,471

(22) Filed: Dec. 30, 2004

(65) Prior Publication Data

US 2006/0017713 A1 Jan. 26, 2006

(30) Foreign Application Priority Data

Jul. 23, 2004 (KR) ..... 10-2004-0057595

(51) Int. Cl.
*G09G 5/00* (2006.01)

(52) U.S. Cl. ..... 345/204; 345/87

(58) Field of Classification Search ..... 345/94, 345/99, 89, 87, 690, 204; 327/355, 361
See application file for complete search history.

(56) References Cited

U.S. PATENT DOCUMENTS 5,495,265 A * 2/1996 Hartman et al. ..... 345/87
6,259,425 B1 7/2001 Shimizu
2002/0024481 A1* 2/2002 Kawabe et al. ..... 345/87
2003/0048246 A1* 3/2003 Ham ..... 345/87
2003/0128176 A1* 7/2003 Ham ..... 345/87

FOREIGN PATENT DOCUMENTS

| | | | |
|---|---|---|---|
| JP | 06-110414 | * | 9/1992 |
| JP | 06-110414 | | 4/1994 |
| JP | 11-326870 | | 11/1996 |
| JP | 2001-066572 | | 3/2001 |
| JP | 2002-366079 | | 12/2002 |

OTHER PUBLICATIONS

Notification of First Office Action for corresponding Chinese Patent Application Serial No. 200510066133.X, dated Sep. 28, 2007.
Office Action issued in corresponding Japanese Patent Application No. 2005-188144; issued mailed Aug. 13, 2008).
Office Action issued in corresponding Japanese Patent Application No. 2005-188144; issued Apr. 21, 2010.

* cited by examiner

*Primary Examiner* — Yong H Sim
(74) *Attorney, Agent, or Firm* — Brinks Hofer Gilson & Lione

(57) ABSTRACT

A driving circuit of an LCD device contains a driving circuit. The driving circuit includes a digital-to-analog converter that outputs a first data signal by converting a digital data signal to an analog data signal; a modulator that outputs a second data signal by modulating the amplitude and pulse width of the first data signal; and a combiner that combines the first data signal with the second data signal. The combiner provides the combined data signal to a data line of an LCD panel.

18 Claims, 6 Drawing Sheets

DRIVING CIRCUIT OF LIQUID CRYSTAL DISPLAY DEVICE AND METHOD FOR DRIVING THE SAME

The present application claims the benefit of the Korean Application No. P2004-57595 filed on Jul. 23, 2004, which is hereby incorporated by reference.

FIELD

The present invention relates to a liquid crystal display (LCD) device, and more particularly, to a driving circuit of an LCD device and a method for driving the same, to improve a response speed of liquid crystal molecule without an additional memory.

BACKGROUND

Discussion of the Related Art

In general, an LCD device largely includes an LCD panel for displaying a video signal, and a driving circuit for applying a driving signal to the LCD panel.

Although not shown, the LCD panel includes two transparent glass substrates bonded to each other at a predetermined interval, and a liquid crystal layer formed between the bonded two substrates. One of the two glass substrates includes a plurality of gate and data lines crossing each other to define a plurality of pixel regions, a plurality of pixel electrodes formed in the respective pixel regions, and a plurality of thin film transistors formed at crossing portions of the gate and data lines for applying data signals of the data lines to the respective pixel electrodes according to scanning signals of the gate lines.

Accordingly, as turn-on signals are sequentially applied to the gate lines, the data signal is applied to the pixel electrode of the corresponding line, thereby displaying an image.

FIG. 1 is a block diagram of a driving circuit of a related art LCD device.

As described above, the related art LCD device includes an LCD panel 11, a driving circuit 12, and a backlight 18. The LCD panel 11 includes a plurality of gate lines G and a plurality of data lines D. Each of the gate lines G is perpendicular to each of the data lines D, so as to define a pixel region. Also, the driving circuit 12 provides a driving signal and a data signal to the LCD panel 11, and the backlight 18 provides a uniform light source to the LCD panel 11.

The driving circuit 12 includes a data driver 11*b*, a gate driver 11*a*, a timing controller 13, a power supply unit 14, a gamma reference voltage unit 15, a DC/DC converter 16, and an inverter 19. The data driver 11*b* inputs a data signal to each data line D of the LCD panel 11, and the gate driver 11*a* supplies a scanning pulse to each gate line G of the LCD panel 11. Then, the timing controller 13 receives display data R/G/B, vertical and horizontal synchronous signals $V_{sync}$ and $H_{sync}$, a clock signal DCLK and a control signal DTEN from a driving system 17 of the LCD panel 11, and formats the display data, the clock signal and the control signal at a timing suitable for restoring a picture image by the gate driver 11*a* and the data driver 11*b* of the LCD panel 11. The power supply unit 14 supplies a voltage to the LCD panel 11 and the respective units. Also, the gamma reference voltage unit 15 receives power from the power supply unit 14 to provide a reference voltage required when digital data inputted from the data driver 11*b* is converted to analog data. The DC/DC converter 16 outputs a constant voltage $V_{DD}$, a gate high voltage $V_{GH}$, a gate low voltage $V_{GL}$, a reference voltage $V_{ref}$, and a common voltage $V_{com}$ for the LCD panel 11 by using a voltage outputted from the power supply unit 14. Also, the inverter 19 drives the backlight 18.

At this time, an equivalent circuit of the pixel region of the LCD panel according to the related art will be described in detail.

FIG. 2 is the equivalent circuit diagram of the pixel region of the LCD panel of FIG. 1. As shown in FIG. 2, the equivalent circuit of the pixel region of the LCD panel includes a thin film transistor 20, a liquid crystal capacitor $C_{LC}$, and a storage capacitor $C_{st}$. The thin film transistor 20 has a source electrode and a gate electrode respectively connected with the data line D and the gate line G formed on a lower substrate. Also, the liquid crystal capacitor $C_{LC}$ is formed between a pixel electrode being connected with a drain electrode of the thin film transistor 20 and a common electrode formed on an upper substrate. Then, the storage capacitor $C_{st}$ is formed between the pixel electrode connected with the drain electrode of the thin film transistor 20 and the adjacent gate line G, or an additional storage line.

An operation of the related art LCD device will be described as follows.

First, according as the gate signal is applied to the gate line, the thin film transistor 20 is turned-on, whereby a data voltage signal VP of the data line D is applied to each frame of the pixel electrode.

After that, an electric field generated by a difference between the data voltage signal $V_p$ applied to the pixel electrode and the common voltage $V_{com}$, and the electric field is applied to the liquid crystal layer, thereby changing alignment of liquid crystal molecules in the liquid crystal layer. Accordingly, it is possible to change the transmittance of light through the liquid crystal molecules according to the alignment of the liquid crystal molecules. At this time, the storage capacitor $C_{st}$ maintains the data voltage signal $V_p$ applied to the pixel electrode during one frame, thereby displaying the image of one frame.

Meanwhile, the liquid crystal molecules have dielectric anisotropy, so that a dielectric constant of the liquid crystal layer is changed dependent on the change in longitudinal axis of the liquid crystal molecules. Thus, the data voltage signal $V_p$ stored in the liquid crystal capacitor is changed on change of the dielectric constant. That is, in case the data voltage signal $V_p$ applied to the liquid crystal layer is changed from a low level to a high level (or high level to low level), the changed data voltage signal is influenced by the data voltage signal $V_p$ before the change, so that the changed data voltage signal $V_p$ does not attain the desirable peak voltage until several frames thereafter.

Accordingly, the data voltage signal $V_p$ is modulated to have a higher value more than a normal value, to over-drive the liquid crystal molecules, thereby obtaining a rapid response speed of the liquid crystal molecules.

Hereinafter, a driver for over-driving in the related art LCD device will be described as follows.

FIG. 3 is a block diagram of a driver for over-driving in the related art LCD device. As shown in FIG. 3, the driver for over-driving includes a delay unit 31, and an LUT memory 32. The delay unit 31 stores data signals inputted in sequence, and outputs the data signal $D_{n-1}$ prior to one frame. Also, the LUT memory 32 compares the data signal $D_{n-1}$ prior to one frame with the data signal $D_n$ of the present frame, and outputs a compensating data signal $D_0$ of the data signal $D_n$ using a Look-Up Table. Herein, the delay unit 31 is comprised of a first memory 31*a* and a second memory 31*b* alternately storing and outputting the data signals inputted in sequence by frame.

An operation of the driver for over-driving in the related art LCD device will be described in detail.

First, the first memory 31*a* and the second memory 31*b* alternately store and output the data signals inputted in sequence by frame.

If the data signal of the first frame is inputted, the delay unit 31 stores the data signal of the first frame in the first memory 31*a*. Then, the LUT memory 32 provides the data signal of the first frame to the LCD panel using the timing controller and the data driver, whereby the LCD panel displays the image for the first frame.

Subsequently, the data signal of the second frame is inputted to the delay unit 31 and the LUT memory 32, the delay unit 31 stores the data signal of the second frame in the second memory 31*b*, and simultaneously outputs the data signal of the first frame stored in the first memory 31*a* to the LUT memory 32. That is, the delay unit 31 alternately stores the data signals inputted sequentially in the first memory 31*a* and the second memory 31*b*, and sequentially outputs the data signals. Thus, the delay unit 31 outputs the data signal delayed by one frame to the data signal directly inputted to the LUT memory 32.

Then, the LUT memory 32 compares the data signal of the second frame with the data signal of the first frame inputted from the delay unit 31 using the Look-Up Table, and outputs a compensated data signal for the data signal of the second frame. After that, the compensated data signal is provided to the LCD panel by the timing controller and the data driver, so that the LCD panel displays the image of the second frame. At this time, since the data signal of the second frame is compensated, it is possible to realize a response of liquid crystal for the data signal of the second frame.

However, the driver for over-driving in the related art LCD device has the following disadvantages.

That is, the driver for over-driving in the related art LCD device requires the two memories (the first memory and the second memory) for alternately storing and outputting the data signals inputted in sequence. In addition, the driver for over-driving in the related LCD device requires the LUT memory. Thus, the driver for over-driving in the related LCD device requires at least three memories (the first memory, the second memory, and the LUT memory), thereby increasing the fabrication cost.

SUMMARY

A driving circuit of an LCD device and a method for driving the same is provided in which the response speed of liquid crystal molecules is improved by over-driving without an additional memory.

By way of introduction only, in one aspect, a driving circuit of a display device contains a signal source, a modulator, and a combiner. The signal source outputs a first data signal. The modulator modulates an amplitude and pulse width of the first data signal to produce a second data signal. The combiner combines the first data signal with the second data signal. An analog data signal based on the combined data signal is provided to a data line of a display panel of the display device.

In another aspect, a method for driving a driving circuit of a display device includes modulating an amplitude and pulse width of a first data signal to form a second data signal; combining the first data signal with the second data signal; and providing an analog data signal based on the combined data signal to a data line of a display panel of the display device.

In another aspect, a driving circuit of a display device contains means for over-driving liquid crystal molecules in the LCD display device without using either a delay unit containing memories that store data signals of adjacent frames to be displayed on an LCD display panel and provide the data signals to an LUT memory containing a Look-Up Table, or the LUT memory that provides the data signal of the earlier of the adjacent frames to the LCD panel.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Reference will now be made in detail to the embodiments of the present invention, examples of which are illustrated in the accompanying drawings. Wherever possible, the same reference numbers will be used throughout the drawings to refer to the same or like parts.

Hereinafter, a driving circuit of an LCD device according to the embodiment of the present invention will be described with reference to the accompanying drawings.

Figure 1:
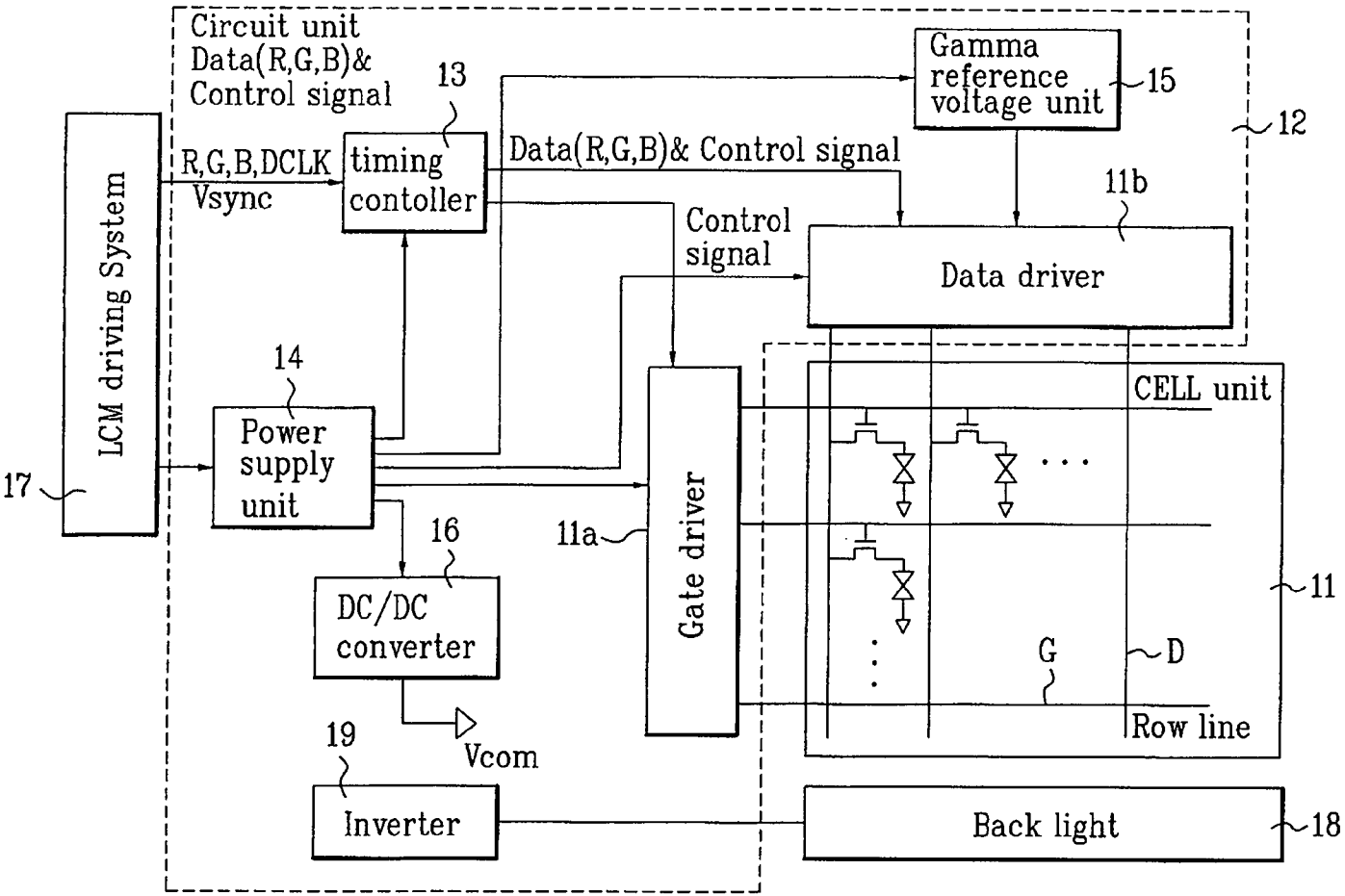
FIG. 1 Related Art
FIG. 1 is a block diagram of a driving circuit of a related art LCD device.
Figure 2:
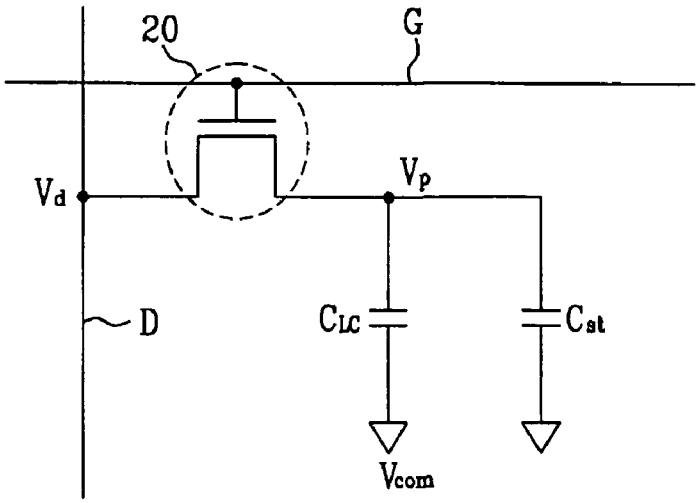
FIG. 2 Related Art
FIG. 2 is an equivalent circuit diagram of a pixel region of an LCD panel of FIG. 1.
Figure 3:
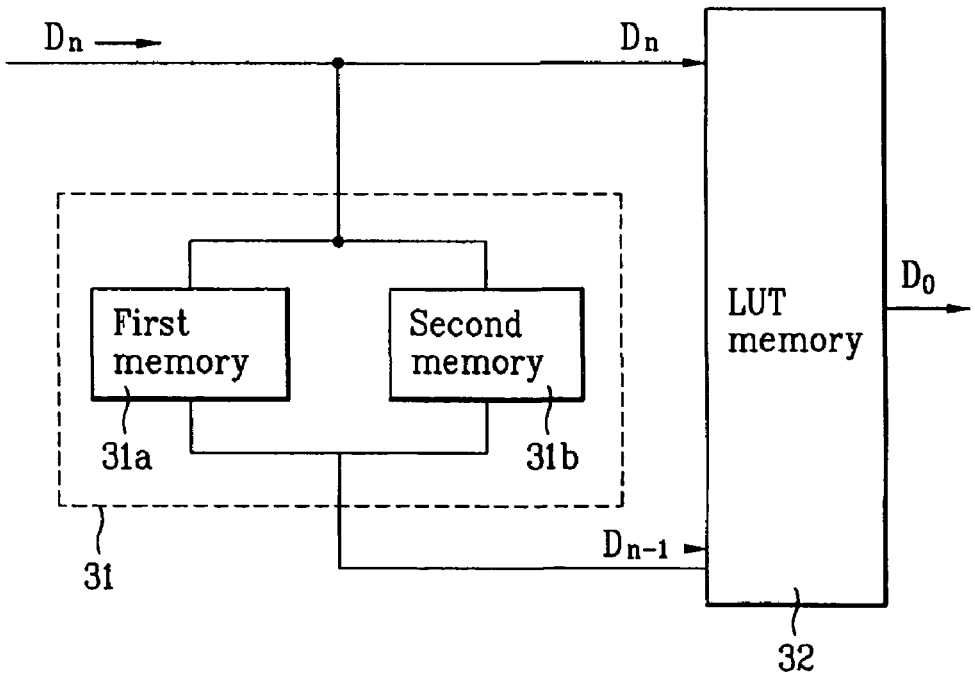
FIG. 3 Related Art
FIG. 3 is a block diagram of a driver for over-driving in a related art LCD device.
Figure 4:
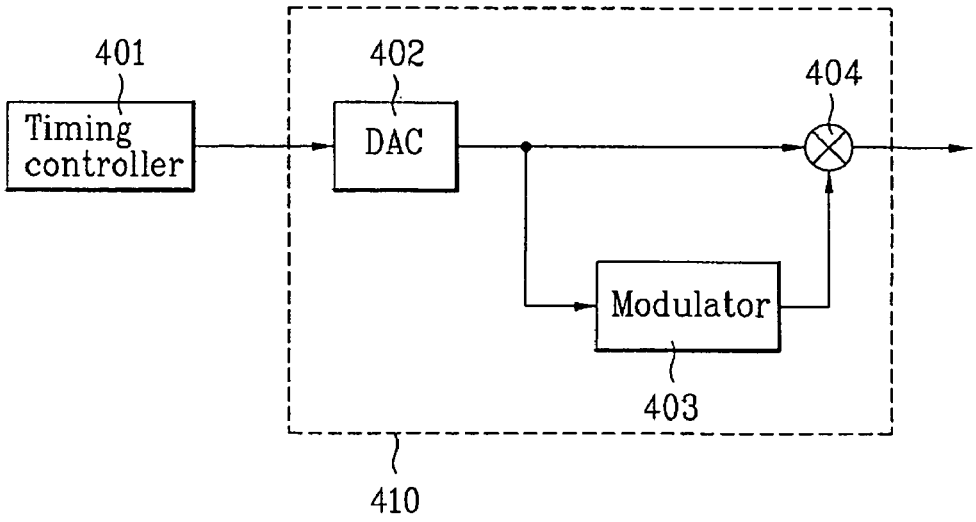
FIG. 4 is a block diagram of a driver of an LCD device according to the first embodiment of the present invention.

FIG. 4 is a block diagram of a driver of an LCD device according to the first embodiment of the present invention.

As shown in FIG. 4, the driver of the LCD device according to the first embodiment of the present invention includes a timing controller 401, a digital-to-analog converter DAC 402, a modulator 403, and a combiner 404. The timing controller 401 formats a first data signal (R/G/B) and control signals inputted from a system at an appropriate timing, and outputs the formatted signals. The DAC 402 receives the formatted first data signal from the timing controller 401, and then converts the received first data signal to an analog data signal. The modulator 403 modulates the amplitude and pulse width of the first data signal outputted from the DAC 402, and then outputs a second data signal. Also, the combiner 404 combines the first data signal outputted from the DAC 402 with the second data signal outputted from the modulator 403, and then provides the combined data signal to a data line of an LCD panel.

In addition, the driver of the LCD device according to the first embodiment of the present invention includes a data driver 410 for mounting the DAC 402, the modulator 403, and the combiner 404 therein.

The modulator 403 modulates the amplitude and the pulse width of the first data signal according to a gray level of the inputted first data signal (the brightness of an image according to the first data signal), thereby outputting the second data signal for all gray levels of the data signal (for example, 256 gray levels). Also, the second data signal outputted from the modulator 403 has a greater amplitude and a shorter pulse width than that of the first data signal outputted from the DAC 402. This will be described in detail.

Figure 5:
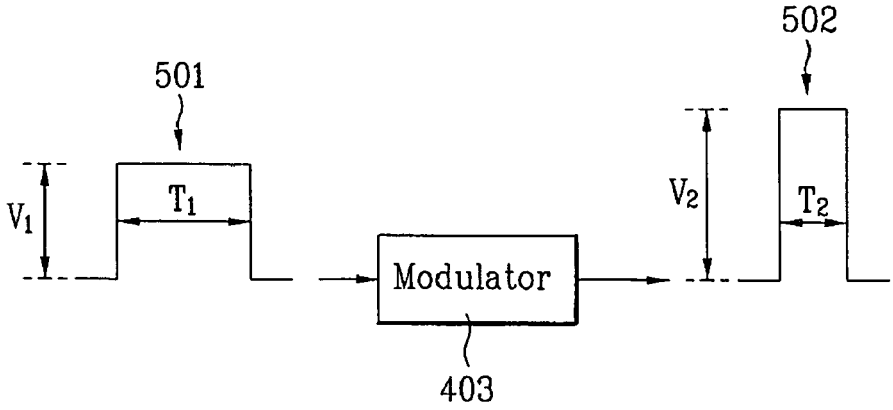
FIG. 5 is an exemplary view of explaining amplitude and pulse width of a data signal outputted from a modulator.

FIG. 5 is an exemplary view of the amplitude and the pulse width of the data signal outputted from the modulator.

That is, as shown in FIG. 5, as a first data signal 501 having a first amplitude V1 and a first pulse width T1 passes through the modulator 403, the first data signal 501 is modulated to a second data signal 502 having a second amplitude V2 and a second pulse width T2. The second amplitude V2 is greater than the first amplitude V1 and the second pulse width T2 is shorter than the first pulse width T1. As described above, the second amplitude V2 and the second pulse width T2 are determined according to the gray level of the first data signal 501 inputted to the modulator 403.

The combiner 404 may use an adder that combines the first data signal 501 outputted from the DAC 402 with the second data signal 502 outputted from the modulator 403. At this time, a combined data signal 600 outputted from the combiner 404 will be explained in detail.

Figure 6:
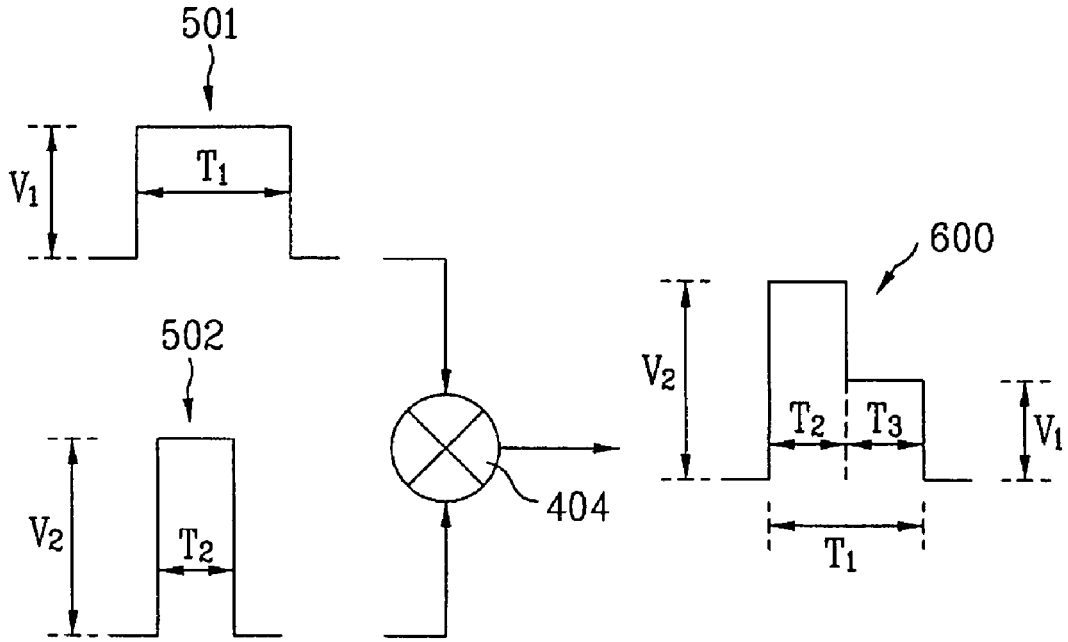
FIG. 6 is an exemplary view of explaining amplitude and pulse width of a data signal outputted from a combiner.

FIG. 6 is an exemplary view of explaining the amplitude and the pulse width of the data signal outputted from the combiner.

That is, as shown in FIG. 6, the data signal 600 outputted from the combiner 404 has the same pulse width T1 as that of the first data signal 501. In this state, the data signal 600 has the same amplitude V2 as that of the second data signal 502 during a period corresponding to the pulse width T2 of the second data signal 502, and has the same amplitude V1 as that of the first data signal 501 during a remaining period T3 (T1-T2).

Although not shown, the LCD panel includes first and second substrates bonded to each other at a predetermined interval, and a liquid crystal layer formed between the first and second substrates. The first substrate (TFT array substrate) includes a plurality of gate lines arranged along a first direction at fixed intervals, a plurality of data lines arranged along a second direction being in perpendicular to the first direction at fixed intervals, a plurality of pixel electrodes arranged in a matrix-type configuration and respectively formed in pixel regions defined by crossing the gate and data lines, and a plurality of thin film transistors being switched by signals of the gate lines to transmit signals of the data lines to the respective pixel electrodes. Next, the second substrate (color filter substrate) includes a black matrix layer for preventing light leakage on remaining portions except the pixel regions, a color filter layer of R/G/B for displaying colors, and a common electrode for realizing an image.

An operation of the driving circuit of the LCD device according to the first embodiment of the present invention will be described as follows.

First, the timing controller 401 outputs the first data signal 501 having the first amplitude V1 and the first pulse width T1, and provides the first data signal 501 to the DAC 402. Then, the DAC 402 converts the first data signal to the analog data signal, and provides the analog data signal to the modulator 403 and the combiner 404. Accordingly, the modulator 403 modulates the first data signal 501, and outputs the second data signal 502 having the second amplitude V2 and the second pulse width T2. The second data signal 502 outputted from the modulator 403 is inputted to the combiner 404, and then the combiner 404 combines the first data signal 501 previously inputted with the second data signal 502, and outputs the combined data signal 600. As explained above, the combined data signal 600 outputted from the combiner 404 has the same pulse width T1 as that of the first data signal 501, and also, has the same amplitude V2 as that of the second data signal 502 during the period corresponding to the pulse width T2 of the second data signal 502, and has the same amplitude V1 as that of the first data signal 501 during the remaining period T3 (T1-T2).

After that, the combiner 404 provides the combined data signal 600 to the data line of the LCD panel. Then, the combined data signal 600 applied to the data line is switched by the thin film transistor, and is applied to the pixel electrode of the pixel region. In this state, a liquid crystal effective voltage substantially applied to liquid crystal molecules according to the combined data signal 600 applied to the pixel electrode will be described as follows.

Figure 7:
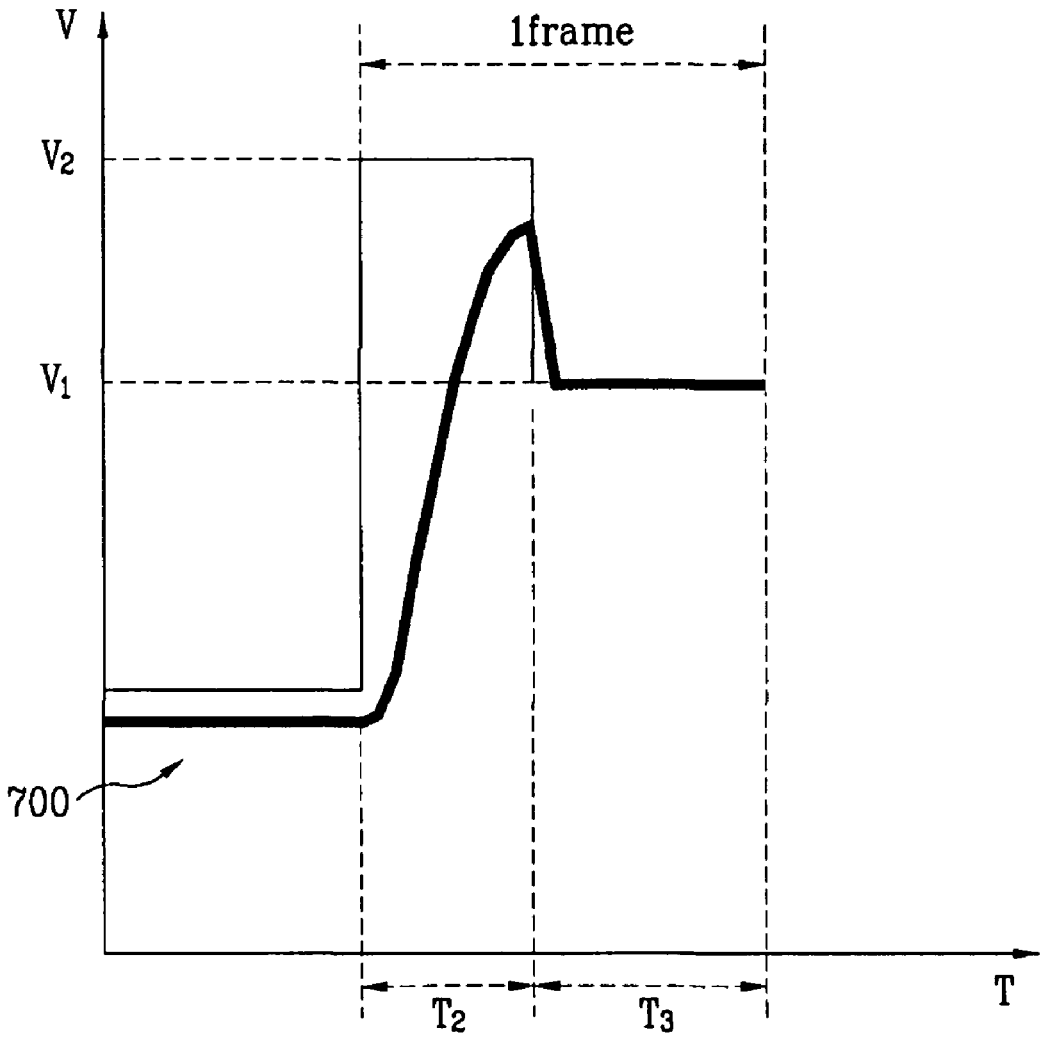
FIG. 7 is an exemplary view of compensating a liquid crystal effective voltage by a combined data signal.

FIG. 7 is an exemplary view of compensating the liquid crystal effective voltage by the combined data signal according to the present invention.

That is, as show in FIG. 7, the liquid crystal effective voltage 700 rises along the second amplitude V2 during the period corresponding to the second pulse width T2 of the combined data signal 600, and drops, thereafter, to be maintained at the first amplitude V1 during the period corresponding to the third pulse width T3. At this time, the first amplitude V1 is a voltage level that is substantially applied to the liquid crystal molecules. As the liquid crystal effective voltage 700 firstly rises not in correspondence to the first amplitude V1 but in correspondence to the second amplitude V2 by using the combined data signal 600, the liquid crystal effective voltage 700 rapidly attains the voltage level corresponding to the first amplitude V1. Accordingly, it is possible to obtain a rapid response speed in the liquid crystal molecules, thereby realizing sufficient gray levels in one frame.

Next, a driver of an LCD device according to the second embodiment of the present invention will be described as follows.

Figure 8:
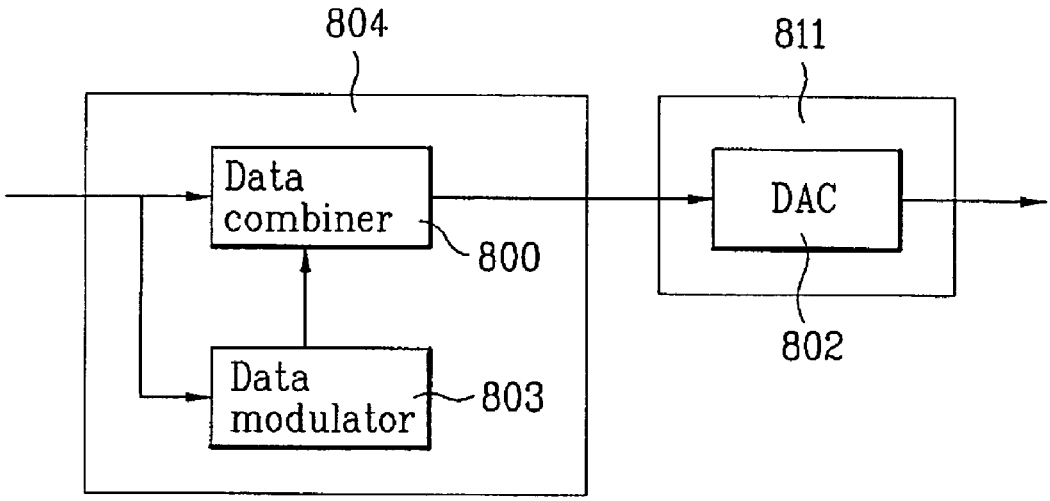
FIG. 8 is a block diagram of a driver of an LCD device according to the second embodiment of the present invention.

FIG. 8 is a block diagram of a driver of an LCD device according to the second embodiment of the present invention.

As shown in FIG. 8, the driver of the LCD device according to the second embodiment of the present invention includes a data modulator 803, a data combiner 800, and a digital-to-analog converter DAC 802. The data modulator 803 modulates amplitude and pulse width of a first digital data signal for driving liquid crystal, and then outputs a second digital data signal. The data combiner 800 combines the first digital data signal with the second digital data signal, and outputs a third digital data signal. After that, the DAC 802 converts the third digital data signal to an analog data signal, and provides the analog signal to a data line of an LCD panel. Also, the driver of the LCD device according to the second embodiment of the present invention further includes a timing controller 804 for mounting the data modulator 803 and the data combiner 800 therein, and a data driver 811 for mounting the DAC 802 therein.

Herein, the data modulator 803 modulates the amplitude and the pulse width of the first digital data signal according to a gray level of the inputted first digital data signal (the brightness in an image according to the data signal), thereby outputting the second digital data signal for all gray levels of the first digital data signal (for example, 256 gray levels).

An operation of the driver of the LCD device according to the second embodiment of the present invention will be described as follows.

First, the first digital data signal having first amplitude data and first pulse width data is outputted from an external system, and then is inputted to the data modulator 803 and the data combiner 800 in the timing controller 804. At this time, the data modulator 803 modulates the first amplitude data and the first pulse width data of the first digital data signal, thereby generating the second digital data signal having second amplitude data and second pulse width data. Then, the second digital data signal having the second amplitude data and the second pulse width data is outputted to the data combiner 800. At this time, the amplitude of the second amplitude data is greater than the amplitude of the first amplitude data, and the pulse width of the second pulse width data has a shorter sustain time than that of the pulse width of the first pulse width data.

Subsequently, the data combiner 800 combines the second digital data signal with the previously inputted first digital data signal, thereby outputting the third digital data signal. When the third digital data signal has the same pulse width data as that of the first digital data signal, the third digital data signal has the same amplitude data as that of the second digital data signal during a period corresponding to the pulse width of the second digital data signal, and has the same amplitude data as that of the first digital data signal during a remaining period.

After that, the third digital data signal is inputted to the DAC 802, and then is converted to the analog data signal. The analog data signal outputted from the DAC 802 is the same signal as the combined data signal 600 in the first embodiment of the present invention. Accordingly, the analog data signal also improves the response speed of the liquid crystal molecules.

As described above, the driving circuit of the LCD device and the method for driving the same according to the present invention has the following advantages.

In the driving circuit of the LCD device according to the present invention, the amplitude and the pulse width of the data signal is modulated, and the modulated data signal is combined with another data signal, thereby generating a combined data signal having an increased amplitude in correspondence with that of the modulated data signal during one section of the entire pulse width. Accordingly, the liquid crystal molecules are over-driven with the modulated data signal, thereby improving the response speed of the liquid crystal molecules.

The present LCD device accordingly does not require an LUT memory for storing a Look-Up Table, and first and second memories for storing data signals, thereby decreasing the fabrication cost for formation of the memories.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A driving circuit of a display device comprising:

a signal source that outputs a first data signal;

a modulator that generates a second data signal using the first data signal only, wherein the modulator modulates an amplitude and pulse width of the first data signal in itself according to a gray level of the inputted first data signal to produce the second data signal, wherein the second data signal has a greater amplitude and shorter pulse width than the first data signal, the amplitude and the pulse width of the second data signal determined according to the gray level of the first data signal, and wherein the modulator outputs the second data signal for all pray levels; and a combiner that combines the first data signal with the second data signal, wherein an analog data signal based on the combined data signal is provided to a data line of a display panel of the display device, wherein the first data signal is supplied to the combiner prior to the second data signal, and wherein a first portion of the combined data signal has an amplitude substantially equal to the amplitude of the second data signal, wherein a second portion of the combined data signal has an amplitude substantially equal to the amplitude of the first data signal.

2. The driving circuit of claim 1, wherein the signal source comprises a digital-to-analog converter that converts a digital data signal into the first data signal, and the first and second data signals are analog data signals.

3. The driving circuit of claim 1, further comprising a digital-to-analog converter that converts the combined digital data signal into the analog data signal, wherein the first and second data signals are digital signals.

4. The driving circuit of claim 1, wherein the combined data signal is substantially L-shaped.

5. The driving circuit of claim 1, wherein the modulator modulates the first data signal depending on a gray level of the first data signal.

6. The driving circuit of claim 2, wherein the analog data signal provided to the data line of the display panel of the display device is the combined data signal.

7. The driving circuit of claim 2, wherein the second data signal is combined with an initial portion of the first data signal.

8. The driving circuit of claim 2, wherein the combiner comprises an adder.

9. The driving circuit of claim 2, further comprising a timing controller that formats the digital data signal supplied to the digital-to-analog converter and controls signals inputted from a system at an appropriate timing.

10. The driving circuit of claim 8, wherein the first data signal has an initial portion and a terminal portion, and the second data signal is added to the initial portion of the first data signal.

11. The driving circuit of claim 9, wherein the digital-to-analog converter, the modulator, and the combiner are all disposed within a data driver.

12. The driving circuit of claim 3, wherein the digital-to-analog converter is disposed within a data driver, and the modulator and the combiner are disposed within a timing controller.

13. The driving circuit of claim 3, wherein the second data signal is combined with an initial portion of the first data signal.

14. A method for driving a driving circuit of a display device comprising:

generating a second data signal using a first data signal only, wherein the step of generating the second data signal includes a step of modulating an amplitude and pulse width of the first data signal in itself according to a gray level of the inputted first data signal to form the second data signal, and wherein the second data signal has a greater amplitude and a shorter pulse width than the first data signal, the amplitude and the pulse width of the second data signal determined according to the gray level of the first data signal, and wherein the step of generating the second data signal further includes outputting the second data signal for all gray levels;

combining the first data signal with the second data signal using a combiner; and providing an analog data signal based on the combined data signal to a data line of a display panel of the display device;

wherein the first data signal is supplied to the combiner prior to the second data signal, and wherein a first portion of the combined data signal has an amplitude substantially equal to the amplitude of the second data signal, wherein a second portion of the combined data signal has an amplitude substantially equal to the amplitude of the first data signal.

15. The method of claim 14, wherein the first and second data signals are digital data signals and the method further comprises converting the combined digital data signal into the analog data signal.

16. The method of claim 14, wherein the first and second data signals are analog data signals and the method further comprises converting a digital data signal into the first data signal prior to modulating the first data signal to form the second data signal.

17. The method of claim 14, wherein the analog data signal is the combined data signal.

18. The method of claim 14, wherein the modulating comprises altering the first data signal depending on a gray level of the first data signal.

* * * * *

UNITED STATES PATENT AND TRADEMARK OFFICE

CERTIFICATE OF CORRECTION

PATENT NO. : 8,102,385 B2
APPLICATION NO. : 11/027471
DATED : January 24, 2012
INVENTOR(S) : Seok Woo Lee et al.

It is certified that error appears in the above-identified patent and that said Letters Patent is hereby corrected as shown below:

In the Claims

In column 8, claim 1, line 5, before "levels; and" replace "pray" with --gray--.

Signed and Sealed this
Twenty-seventh Day of March, 2012

David J. Kappos

David J. Kappos
*Director of the United States Patent and Trademark Office*